United States Patent [19]

Richards

[11] Patent Number: 5,065,843

[45] Date of Patent: Nov. 19, 1991

[54] METHOD FOR INSTALLING ELEVATOR SYSTEM COMPONENTS

[75] Inventor: Douglas Richards, Crayford, England

[73] Assignee: Otis Elevator Company, Farmington, Conn.

[21] Appl. No.: 523,941

[22] Filed: May 16, 1990

[51] Int. Cl.[5] ..... B66B 9/18

[52] U.S. Cl. ..... 187/1 R; 187/95

[58] Field of Search ..... 52/30, 632, 745; 187/1 R, 2, 11, 95, 96

[56] References Cited

U.S. PATENT DOCUMENTS

| | | | |
|---|---|---|---|
| 115,335 | 5/1871 | Macomb | 187/2 |
| 582,028 | 5/1897 | Thomas | 187/2 X |
| 1,326,433 | 12/1919 | Bartlett | 187/95 X |
| 3,851,736 | 12/1974 | Westlake et al. | 187/95 |
| 3,893,219 | 7/1975 | Davis | 187/1 R X |
| 4,345,671 | 8/1982 | Tosato et al. | 187/95 |
| 4,356,890 | 11/1982 | Smart | 187/95 X |

FOREIGN PATENT DOCUMENTS 54-40449 3/1979 Japan .

*Primary Examiner*—Robert P. Olszewski
*Assistant Examiner*—Dean A. Reichard
*Attorney, Agent, or Firm*—William W. Jones

[57] ABSTRACT

The working platform is set up on the highest floor slab in a building being erected so as to cover the elevator hoistway. Extensible finger beams serve to position the platform properly over the hoistway. The platform serves as a template for rail plumb lines and landing door assemblies, and carries winches which are used to lift the rails and door assemblies into place in the hoistway. A false car is suspended in the hoistway below the platform and runs up and down in the hoistway on a hoisting rope. Workers use the false car to install rails and landing door assemblies which have been lifted into place by the winches on the working platform.

1 Claim, 3 Drawing Sheets

METHOD FOR INSTALLING ELEVATOR SYSTEM COMPONENTS

TECHNICAL FIELD

This invention relates to a working platform for using in constructing an elevator system in a building under construction. More particularly, the working platform is placed over the elevator hoistway at the highest floor slab in the building, and serves as a template for plumb lines for rails and landing door locations. The rails and doors may also be winched up through the platform to a temporary construction car suspended in the hoistway below the platform, from which they are installed by workers on the construction car.

BACKGROUND ART

When an elevator system is installed in a building under construction, the location of the guide rails, landing door assemblies and the like must be very carefully plotted so as to ensure proper alignment of these components, the car, the counterweight assembly, the machine and traction sheaves, the governor cable, and all of the various other components of the system. Properly locating the various components can become very complicated especially in high rise buildings.

DISCLOSURE OF THE INVENTION

This invention relates to a working platform which is positioned above the hoistway on the highest floor slab during construction of the building. The platform carries winches for lifting rails, landing doors, and the like from the pit up into the hoistway. The platform also contains prealigned openings at its edges which serve as a template for rail and door placement. Plumb lines are dropped through these template openings for use by the installation crew in fixing the rails and doors in the hoistway. The openings also allow passage of hoisting ropes from the winches whereby the rails and doors can be lifted from the pit and held in place during installation. A temporary construction car, termed a "false car" in the trade is suspended below the platform and travels up and down in the hoistway on a separate hoist rope by means of a winch mounted on the false car. Installation crew members fix the rail and door components in place from the false car using the plumb lines for reference. Periodically, the false car can be shackled to the working platform and the two can be craned up to a new higher level in the building. Extensible finger beams on the platform are used to position and support the platform on the building floor slab. After rail and door installation have commenced to a certain point, a more conventional elevator car is lowered into the hoistway by a crane, and a temporary machine room can likewise be placed in the hoistway above the elevator car, and below the false car and working platform. After that point, the false car and working platform continue to operate above the machine room, and from time to time will continue to be craned up higher in the building. A trap door is placed in the working platform to allow access of the crane line to the temporary machine room to allow craning of the latter upward in the building periodically.

It is therefore an object of this invention to provide a working platform to use in construction of an elevator system in a building under construction.

It is a further object of this invention to provide a working platform of the character described which provides a platform for positioning over the hoistway at the highest floor slab in the building whereby the platform covers the top of the hoistway.

It is an additional object of this invention to provide a working platform of the character described which serves as a plumb line template for positioning of the guide rails and landing door assemblies in the hoistway.

It is another object of this invention to provide a working platform of the character described from which rail and landing door components can be winched up from the hoistway pit for installation from a temporary construction car suspended in the hoistway beneath the working platform.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
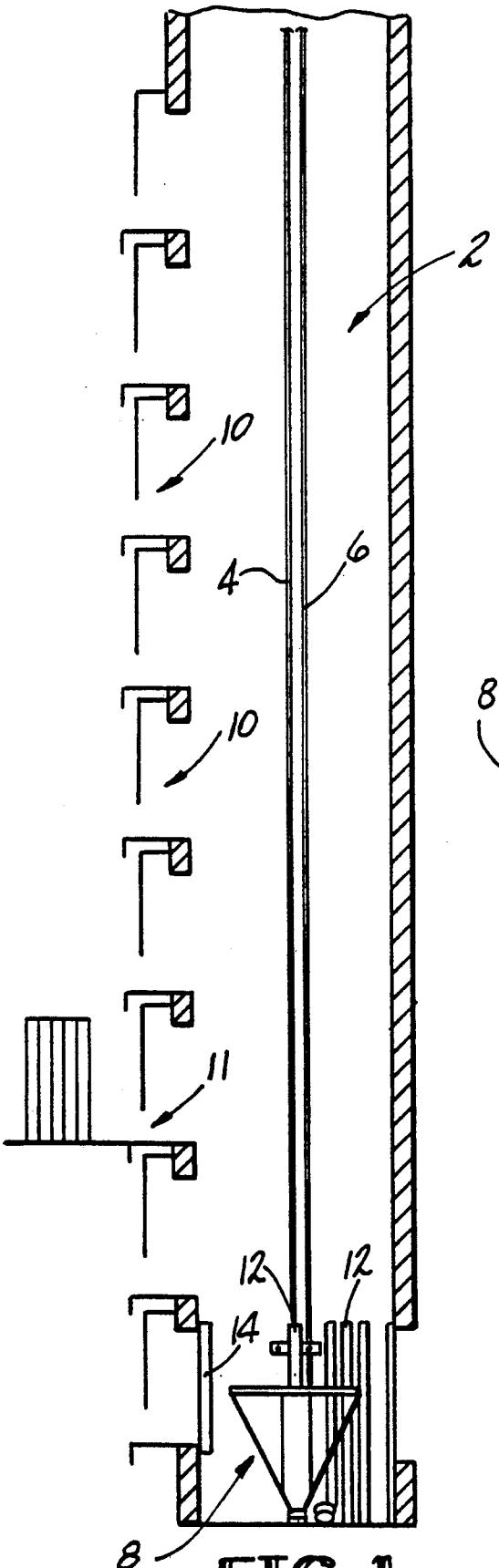
FIG. 1 is a somewhat schematic side sectional view of an elevator hoistway showing the temporary construction, or "false car" and various hoistway equipment in the hoistway pit.
Figure 2:
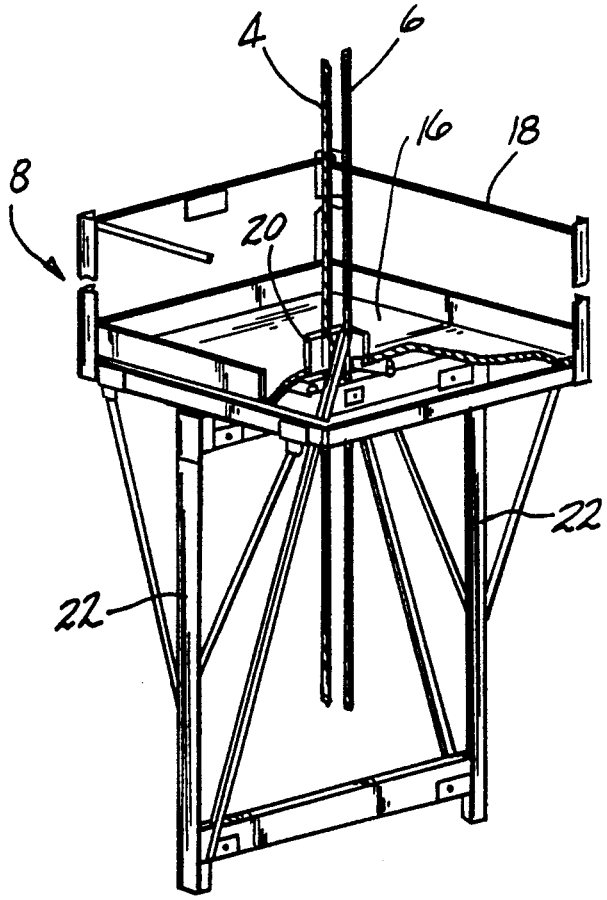
FIG. 2 is a perspective view of the false car.
Figure 3:
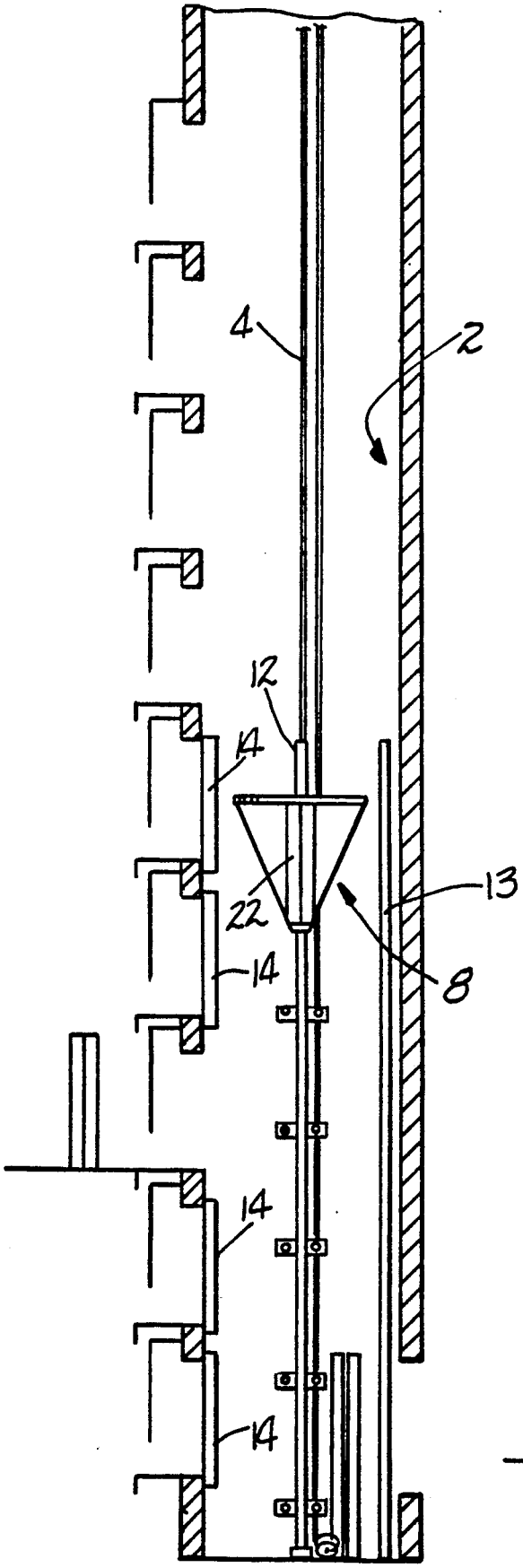
FIG. 3 is a view similar to FIG. 1 showing how the guide rails and landing door assemblies are secured in the hoistway.

Referring now to the drawings, there is shown in FIG. 1 somewhat schematically, an elevator hoistway denoted generally by the numeral 2. There are two ropes 4 and 6 extending from the top of the hoistway 2 to the pit. The rope 4 is a hoisting rope for a temporary construction, or false car 8, and the rope 6 is a safety rope for the false car 8. Along one wall of the hoistway are a plurality of landing door openings 10, one for each floor in the building. Elevator hoistway components such as guide rails 12 and landing door assemblies 14 are mounted in the hoistway 2 by workers from the false car 8. The rails 12 and door assemblies 14 may be brought into the hoistway 2 through the ground floor landing door opening 11, or may be craned into the hoistway 2 from above. Referring to FIG. 2, the false car 8 has a deck 16 and a safety railing 18 thereabout. A winch 20 is mounted on the deck 16 and is used to move the false car 8 up and down in the hoistway over the hoisting rope 4. The construction workers stand on the deck 16 and fasten the various hoistway components in place from there. Guide shoes 22 engage the elevator car guide rails 12 once they are fastened in place in the hoistway 2 as shown in FIG. 3. As seen in FIG. 3, the false car 8 advances up the hoist rope 4 so that the workers can fasten the car guide rails 12, the counterweight guide rails 13, and the landing doors 14 in place in the hoistway 2.

Figure 4:
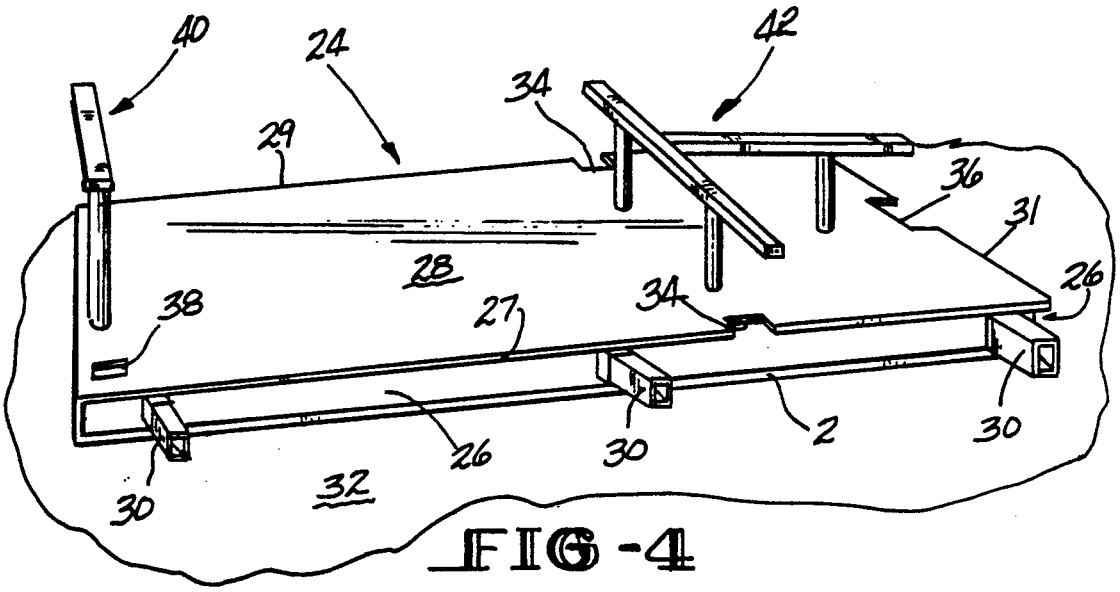
FIG. 4 is a perspective view of the working platform of this invention.
Figure 5:
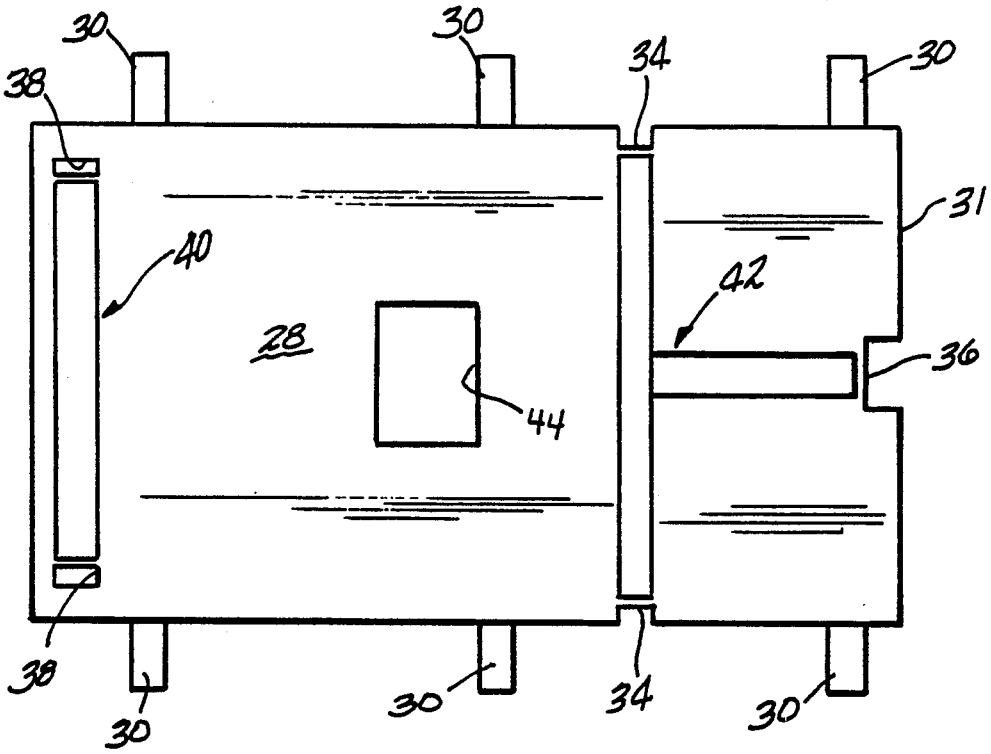
FIG. 5 is a plan view of the working platform.

Referring now to FIGS. 4 and 5, the working platform 24 is shown. The platform 24 has a metal beam frame 26 on top of which is disposed a plywood floor 28. Extensible finger beams 30 are mounted in the frame 26 and can be pulled out to rest upon the floor slab 32 whereby the platform 24 overlies the hoistway 2. The frame members 26 are inwardly offset from the side edges 27, 29 and 31 of the plywood floor 28 and also from the edges of the hoistway 2. The plywood floor 28 is approximately the same cross-sectional area and matches that of the hoistway. Slots 34 are cut into the edges 27 and 29 of the plywood floor 28 at locations conforming to the locations of the elevator car guide rails in the hoistway. The locations of the car guide rails can be plumbed in the hoistway 2 from the platform 24 through the slots 34. A slot 36 is cut in the edge 31 of the plywood floor 28 at a location conforming to the centerline of the landing door assemblies. Those locations can also be plumbed in the hoistway 2 through the slot 36. Openings 38 are cut in the plywood floor 28 at locations coinciding with the counterweight guide rails, and thus can likewise be used to plumb the positions of the counterweight guide rails in the hoistway 2 from the platform 24. A pair of winch mounts 40 and 42 are mounted on the platform 24. The mount 40 has ends which overlie the counterweight guide rail plumb openings 38, and the mount 42 likewise has ends which overlie the car guide rail plumb slots 34 and landing door plumb slot 36. Winches (not shown) are mounted on the mounts 40 and 42 to operate hoisting cables off of the respective ends of the mounts, which cables pass through the slots 34 and 36, and the openings 38. These hoistway cables are used to winch guide rails and landing door assemblies up from the pit to the level of the false car so that the various components can be fastened to the hoistway walls by workers on the false car. A trap door 44 is disposed in the middle of the platform.

It will be readily appreciated that the working platform of this invention can be easily lifted upwardly in a building as the height of the latter increases, whereby rail and other hoistway component installations may progress as the building rises. The platform protects the equipment in the hoistway from the environment, and can be used on different size hoistways due to the extensible supports it incorporates. The platform, while serving as a stage whereby hoistway components can be lifted up in the hoistway for securement to the walls thereof, also serves as a template for properly locating these components via plumb lines dropped into the hoistway through prealigned openings in the platform.

Since many changes and variations of the disclosed embodiment of the invention may be made without departing from the inventive concept, it is not intended to limit the invention otherwise than as required by the appended claims.

What is claimed is:

1. A method for installing elevator system components in an elevator hoistway in a building under construction, said method comprising;

(a) positioning a construction elevator in said hoistway along with the elevator system components;

(b) hoisting said construction elevator in the hoistway;

(c) positioning a working platform over a top of the hoistway to cover the hoistway;

(d) plumbing lines of installation for each elevator system component in the hoistway from the working platform when the latter is positioned at the top of the hoistway;

(e) winching the elevator system components upward in the hoistway from the working platform while the latter is positioned at the top of the hoistway along the plumb lines to the construction elevator; and (f) securing the elevator system components along the plumb lines from the construction elevator.

* * * * *